US010011924B2

(12) United States Patent
Hiepp et al.

(10) Patent No.: US 10,011,924 B2
(45) Date of Patent: Jul. 3, 2018

(54) METHOD FOR OPERATING A SPINDLE OF A TWO-FOR-ONE TWISTING OR CABLING MACHINE AND ASSOCIATED TWO-FOR-ONE TWISTING OR CABLING MACHINE

(71) Applicant: Saurer Germany GmbH & Co. KG, Remscheid (DE)

(72) Inventors: Magnus Hiepp, Kempten (DE); Walter Pede-Vogler, Durach (DE); Alexander Thaler, Burggen (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 154 days.

(21) Appl. No.: 15/097,397

(22) Filed: Apr. 13, 2016

(65) Prior Publication Data

US 2016/0319468 A1 Nov. 3, 2016

(30) Foreign Application Priority Data

Apr. 28, 2015 (DE) ..... 10 2015 005 447

(51) Int. Cl.
*D01H 15/00* (2006.01)
*D01H 1/10* (2006.01)
(Continued)

(52) U.S. Cl.
CPC ..... *D01H 15/007* (2013.01); *D01H 1/10* (2013.01); *D01H 7/86* (2013.01); *D01H 7/866* (2013.01);
(Continued)

(58) Field of Classification Search
CPC ..... D01H 13/22; D01H 13/26; D01H 13/32; D01H 13/007; D01H 13/106; D01H 7/86;
(Continued)

(56) References Cited

U.S. PATENT DOCUMENTS 2,386,704 A * 10/1945 McLellan ..... D01H 1/425 57/357
3,290,873 A * 12/1966 Vibber ..... D02G 3/285 57/58.3
(Continued)

FOREIGN PATENT DOCUMENTS

CN 103147188 A 6/2013
DE 4121913 A1 1/1992
(Continued)

OTHER PUBLICATIONS

European Search Report for corresponding European Patent Application No. 16000764.7 dated Sep. 21, 2016; all enclosed pages cited.

*Primary Examiner* — Ismael Izaguirre

(74) *Attorney, Agent, or Firm* — Nelson Mullins Riley & Scarborough LLP

(57) ABSTRACT

A method for operating a spindle (2) of a two-for-one twisting or cabling machine, in which an outer yarn (5) is drawn off a first feed package (7) and the spindle (2) rotates in a yarn balloon (B), wherein the spindle (2) comprises a device (6) for influencing the balloon yarn tension of an outer yarn (5), which is connected to a control circuit (18), and has a spindle pot (19) for receiving a second feed package (15), a yarn deflection device (20), a balancing system (9) for forming a twisting or cabling point as well as a spooling and winding device (12). The drive of the yarn balloon (B) is performed via a fixed throw-off point (21) on the yarn deflection device (20).

16 Claims, 3 Drawing Sheets

(51) Int. Cl.

| | |
|---|---|
| ***D01H 7/86*** | (2006.01) |
| ***D02G 3/28*** | (2006.01) |
| ***D01H 15/007*** | (2006.01) |
| ***D01H 13/10*** | (2006.01) |

(52) U.S. Cl.
CPC ..... *D01H 13/106* (2013.01); *D01H 15/00* (2013.01); *D02G 3/28* (2013.01); *D02G 3/285* (2013.01)

(58) Field of Classification Search
CPC ..... D01H 7/866; D01H 1/10; D01H 15/00; D01H 15/007; B65H 57/00; B65H 57/02; B65H 57/22; D02G 3/285; D02G 3/28
See application file for complete search history.

(56) References Cited

U.S. PATENT DOCUMENTS 3,445,998 A * 5/1969 Yamashita ..... D01H 13/106 242/147 R
3,499,277 A 3/1970 Vibber
4,034,544 A * 7/1977 Clarkson ..... D02G 3/285 57/284
5,150,566 A * 9/1992 Stenmans ..... D01H 7/04 57/113
5,263,308 A * 11/1993 Lee ..... D02G 3/285 252/8.84
6,098,392 A * 8/2000 Tung ..... D02G 3/24 57/11
8,256,199 B2 9/2012 Schlagenhaft
8,650,849 B2 2/2014 Pede-Vogler

FOREIGN PATENT DOCUMENTS

| | | | |
|---|---|---|---|
| DE | 10260121 | A1 | 7/2004 |
| DE | 102008033849 | A1 | 1/2010 |
| DE | 102011113614 | A1 | 3/2013 |
| EP | 1167597 | A1 | 1/2002 |
| WO | 2004057073 | A1 | 7/2004 |
| WO | 2009019359 | A2 | 2/2009 |

* cited by examiner

METHOD FOR OPERATING A SPINDLE OF A TWO-FOR-ONE TWISTING OR CABLING MACHINE AND ASSOCIATED TWO-FOR-ONE TWISTING OR CABLING MACHINE

CROSS-REFERENCE TO RELATED APPLICATIONS

This application claims priority from German National Patent Application No. DE 102015005447.3, filed Apr. 28, 2015, entitled "Verfahren zum Betrelben einer Spindel einer Doppeldrahtzwirn oder Kabliermaschine sowie zugehörige Doppeldrahtzwirn oder Kabliermaschine", the entire contents of which are incorporated herein by reference.

FIELD OF THE INVENTION

The present invention relates to a method for operating a spindle of a two-for-one twisting or cabling machine and a two-for-one twisting or cabling machine for carrying out such method.

BACKGROUND OF THE INVENTION

The spindle of a two-for-one twisting or cabling machine is known to be used for the production of twisting, winding yarns or the like from at least two yarns drawn off bobbins, which are generally referred to as an inner yarn or outer yarn.

The bobbin for the inner yarn is often positioned in a so-called spindle pot, which is supported in the region of the axis of rotation of the spindle on a yarn deflection device and is secured by magnets against rotation.

The bobbin of the associated outer yarn is preferably suspended in a creel which is arranged above or behind the two-for-one twisting or cabling machine.

In connection with such two-for-one twisting or cabling machines it has been known for a long time, for example from German Patent Publication DE 41 21 913 A1, to influence the yarn tension of the inner yarn and the yarn tension of the outer yarn on a cording spindle by means of adjusting devices such that the yarns in the cabling point are brought together at the correct yarn tension and speed. This means that the outer yarn is influenced by an outer yarn brake, the braking effect of which is controlled as a function of an inner yarn brake influencing the yarn brake.

In the two-for-one twisting or cabling machine according to German Patent Publication DE 41 21 913 A1 the outer yarn, coming from the outer yarn brake, is introduced centrally into a cording spindle and exits radially at a rotating storage disc which is secured underneath a twisting plate on the cording spindle.

The outer yarn thereby wraps round the storage disc, which balances out yarn tensions caused by fluctuations in the delivery of the yarn, at least partly, before the yarn is moved over the outer edge of the twisting plate into a free yarn balloon, the form and diameter of which is dependent on various factors. Some of these factors are for example the diameter of the storage disc and the twisting plate, the balloon height, the titre of the yarn and the spindle speed of the workstation.

As the optimum adjustment of the aforementioned factors to one another requires a relatively large amount of effort, or is only possible to a limited degree, this effort is often shied away from, as a result of which the form and the diameter of the free yarn balloon are not optimal, which has a very disadvantageous effect on the power consumption of the spindle.

It has therefore already been proposed, for regulating the fluctuations in form and diameter of the free yarn balloon, which are known to be caused by fluctuations in the speed of yarn delivery, to avoid the use of a storage disc arranged underneath a twisting plate and instead to control the yarn tension by means of a balloon limiting pot rotating with the spindle.

By means of European Patent Publication EP 1 167 597 B1 for example a cabling device is known in which a balloon limiting pot prevents the formation of a free yarn balloon. This means that by having a co-rotating pot the outer yarn rotating about the spindle is limited in its radial extension. Furthermore, because of the friction of the running outer yarn on the inner wall of the balloon limiting pot the yarn tension is controlled which corresponds to the effect of using a storage disc.

By using the co-rotating pot designed as a balloon limiter, which absorbs the radial forces of the outer yarn, the yarn tension of the outer yarn is lower than in the cabling device known from German Patent Publication DE 41 21 913 A1 with a storage disc, the cabling device known from European Patent Publication EP 1 167 597 B1 has the disadvantage however that on the one hand the co-rotating balloon limiting pot is exposed to considerable wear from the running outer yarn and the balloon limiting pot also has to be moved along as a rotating mass by the spindle drive. The air friction of the co-rotating balloon limiting pot causes additional losses which have to be compensated by the spindle drive.

In practice no power can be saved with cabling devices, which have a co-rotating balloon limiting pot compared to cabling devices which operate with a storage disc and a free yarn balloon.

A method for operating a spindle of a two-for-one twisting or cabling machine, which is characterized by reduced energy consumption and an associated two-for-one twisting or cabling machine are described in German Patent Publication DE 10 2008 033 849 A1.

In this known method it is proposed to adjust the feeding speed of the outer yarn so that in the region of the twisting plate there can be no storage and the yarn tension of the outer yarn has a value which minimises the diameter of the free yarn balloon circulating the spindle as a function of the geometry of the spindle. This means that in this known method the yarn tension is set so that the adjusted yarn tension is greater than the self-adjusting yarn tension when using a storage disc or a co-rotating pot.

By means of the method described in German Patent Publication DE 10 2008 033 849 A1 the previously valid principle is disproved that a free yarn balloon then only has a marked, unalterable geometry, if it is subjected to storage on a storage disc or is forced through a rotating pot, by means of which a required balancing function is ensured in the twisting or cabling system.

In German Patent Publication DE 10 2008 033 849 A1 by means of the increased yarn tension of the outer yarn before it enters a guiding device, a different launch angle is set on the edge of the twisting plate because of the reduced balloon diameter than the launch angle which is set on the tangential lifting of the yarn from a conventional spindle with a storage disc with the formation of a free yarn balloon or with a yarn balloon forced through a co-rotating balloon limiting pot.

As the required drive power of a spindle, as already explained above, is heavily dependent on the balloon diameter, the reduction of the diameter of the free yarn balloons means that the energy required for forming and maintaining the rotation of the yarn balloon decreases.

In the method known from German Patent Publication DE 10 2008 033 849 A1 however, it is not entirely impossible for the outer yarn to have a storage tendency, for example when starting up the spindle.

In connection with the spindles of two-for-one twisting or cabling machines also yarn rotating devices are known which are designed for example in the form of a blade.

In International Patent Publication WO 2004/057073 A1 for example different such blade-like rotating devices are described for the spindles of two-for-one twisting or cabling machines.

As the spindles of these known two-for-one twisting or cabling machines are not equipped with either a storage disc or a co-rotating pot and also have no controllable device, by means of which the yarn tension of the outer yarn is adjusted to a value at which the diameter of the free yarn balloon rotating around the spindle is minimised as a function of the geometry of the spindle, in the spindles of these known two-for-one twisting or cabling machines free yarn balloons are formed, the form and diameter of which are not at all optimum.

In the case of blade-like rotary devices, as described in International Patent Publication WO 2004/057073 A1, because of fluctuations in the yarn tension, which are determined by fluctuations in the speeds of the yarn supply, often free yarn balloons are formed with a relatively large diameter which has a very disadvantageous effect on the power consumption of the spindle.

SUMMARY OF THE INVENTION

On the basis of the aforementioned prior art the problem addressed by the invention is to develop a method for operating a spindle of a two-for-one twisting or cabling machine, which on the one hand is characterized by reduced power consumption and on the other hand ensures at all times a secure, correct operation of the spindles.

According to the invention, a method is provided for operating a spindle of a two-for-one twisting or cabling machine, in which an outer yarn is drawn off a feed package and the spindle rotates in a yarn balloon. The spindle of the two-for-one twisting or cabling machine comprises a spindle pot, a yarn deflection device, a device for forming a twisting or cabling point, a device for influencing the balloon yarn tension and a control circuit. Furthermore, the drive of the yarn balloon is performed via a fixed throw-off point on a rotating yarn deflection device.

A two-for-one twisting or cabling machine for carrying out the method comprises a spindle, which has a device for influencing the balloon yarn tension of an outer yarn, which is connected to a control circuit, and has a spindle pot for receiving a second feed package, a yarn deflection device, and a balancing system for forming a twisting or cabling point and a spooling and winding device, wherein the rotatably mounted yarn deflection device has a fixed throw-off point for the outer yarn.

The invention provides further advantageous embodiments of the method and further advantageous embodiments of the associated two-for-one twisting or cabling machine.

The method according to the invention not only has the advantage that the spindle has a good power balance during the twisting or cabling process because of the yarn balloon with a reduced diameter, but avoiding any storage of the outer yarn also results in very gentle handling of the yarn material. This means that avoiding the use of a storage disc apart from reducing the number of components which are partly very expensive has further, different, additional and not insignificant advantages.

The lower surface variance as result of omitting a storage disc leads for example to improved rotating properties of the spindle and thus to an improved oscillation behaviour of said component.

Furthermore, by omitting a storage disc the risk that windings will be formed during the twisting or cabling process is considerably reduced or eliminated. Lastly, by omitting a storage disc the accessibility of the workstation as a whole is improved, so that if necessary also a simpler replacement of yarn/yarn guiding elements is possible.

This means that in the method according to the invention it is not only possible to prevent the yarn getting damaged by means of greater surface contact of the yarn material with a storage disc or with a balloon limiting pot, but from the form and the size of the diameter of the yarn balloon around the spindle it is also easy to identify the actual yarn tension, which if necessary can be corrected easily.

It is also advantageous in the method according to the invention that in contrast to using a storage disc where correct yarn storage is relatively difficult by adjusting the correct balloon tension, by way of the freely visible yarn balloon rotating round the respective balloon tension can be recognised spindle at any time and by a device for influencing the balloon yarn tension an optimal yarn balloon form can always be adjusted.

In an alternative embodiment however, the use of a so-called barrel tensioner is possible with which it is possible to work with only a relative low yarn storage volume.

The device for influencing the balloon yarn tension is preferably connected to a control circuit which controls the device such that a desired yarn balloon size can be adjusted.

In an advantageous embodiment the control circuit controls the device for influencing the balloon yarn tension so that there is automatically a minimum yarn balloon size.

This means that by way of this device for influencing the balloon yarn tension the supply speed of the yarn is kept as constant as possible or continual adjustment fluctuations are avoided in the supply of the yarn which could cause a break in the yarn or fluctuations in the form and size of the rotating yarn balloon.

In an advantageous embodiment the control circuit, when starting up or powering down the spindle and in the case of a brief power cut, also controls the device for influencing the balloon yarn tension such that a yarn balloon size is produced in which both contact with the fixed spindle pot and also contact with the separator arranged between the workstations are avoided.

Such an embodiment makes it possible to obtain a compact structure of the workstations with a reduced workstation division compared to known two-for-one twisting or cabling machines, with the result that the space required by the two-for-one twisting or cabling machines is reduced.

As already explained above in connection with the method according to the invention, the two-for-one twisting or cabling machine is provided with a spindle which comprises a spindle pot, a yarn deflection device, a device for forming a twisting or cabling point, a device for influencing the balloon yarn tension and a control circuit. Furthermore, the rotatably mounted yarn deflection device has a fixed throw-off point for the outer yarn.

An embodiment of this kind not only has the advantage that by omitting a storage disc or a co-rotating balloon limiting pot fewer components are required per spindle but that by means of the fixed throw-off point on the rotatably mounted yarn deflection device the correct rotation of the yarn balloon is ensured at all times.

In an advantageous embodiment the fixed throw-off point can have different embodiments on the rotatably mounted yarn deflection device.

The fixed throw-off point can be formed for example by an eyelet which is arranged in the outer area of a twisting plate or in the free end section of a twisting blade.

In another embodiment the fixed throw-off point is formed by the outlet of a closed channel, which preferably extends between a yarn exit bore in the region of the axis of rotation of the spindle and the outer area of a twisting plate, or between a yarn exit bore in the region of the axis of rotation of the spindle and the end section of a twisting blade.

In a further embodiment the fixed throw-off point is formed by the end of a slot open at the bottom, which is arranged for example between a yarn exit bore in the region of the axis of rotation of the spindle and the outer area of a twisting plate or between a yarn exit bore in the region of the axis of rotation of the spindle and the end section of a twisting blade.

In an alternative embodiment it is also the case that the fixed throw-off point is a component of a rotatably mounted barrel tensioner.

Such a barrel tensioner preferably has a hub-like main body with yarn bore running axially relative to the axis of rotation of the spindle axial and a yarn exit bore coming radially from the latter. In addition, the barrel tensioner has a plate-like shoulder connected to the main body which is equipped with a fixed throw-off point for the yarn, preferably with a wear-resistant eyelet.

An embodiment of this kind has the advantage that by means of such a barrel tensioner in a simple, reliable manner directly in front of the rotating yarn balloon an almost constant, additional yarn tension is created.

Preferably the twisting plates, the twisting blades and/or the barrel tensioner are designed so that they are self-threading. This means in the case of a restart that the yarn is threaded automatically into the throw-off point of the yarn deflection device.

The controllable device for influencing the balloon yarn tension is preferably designed either as a brake or set up as an active supply device.

This means that a controllable device for influencing yarn tension is connected upstream of the yarn deflection device, by means of which the supply speed of the yarn is adjusted so that the yarn tension of the yarn entering the yarn deflection device always has a value which minimises the diameter of the yarn balloon circling the spindle as a function of the geometry of the spindle, which has a positive effect on the power consumption of the spindle drive.

BRIEF DESCRIPTION OF THE DRAWINGS

The invention is explained in more detail in the following with reference to the example embodiments shown in the drawings, wherein.

DETAILED DESCRIPTION OF THE INVENTION

Figure 1:
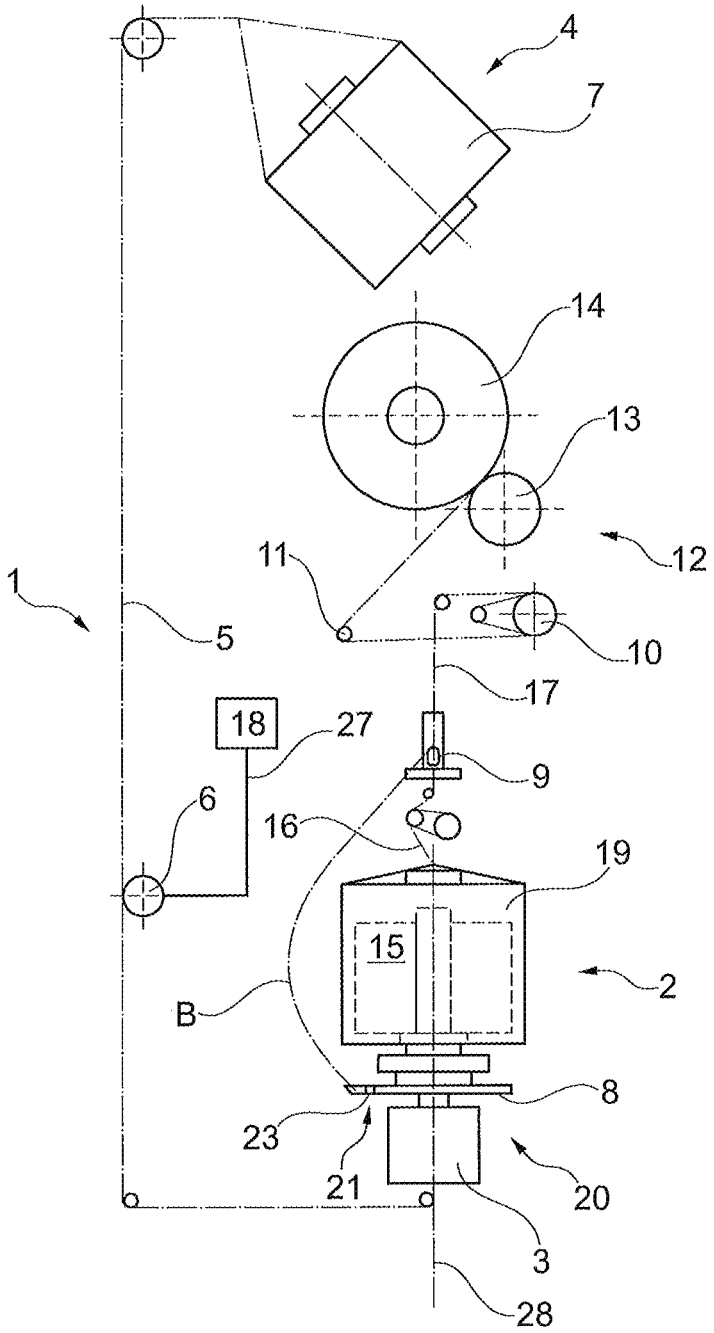
FIG. 1 shows schematically, in side view a workstation of a two-for-one twisting or cabling machine, with a yarn deflection device, which has a fixed throw-off point, FIG. 2*a, b, c* shows different embodiments of a yarn deflection device designed as a twisting plate, in a view from below, FIG. 3*a, b, c* shows different embodiments of a yarn deflection device designed as a twisting blade in a view from below.

FIG. 1 shows schematically in side view a workstation of a two-for-one twisting or cabling machine which is denoted overall by the reference numeral 1.

With reference to the shown workstation 1 the method according to the invention is also explained in the following.

The workstation 1 of the two-for-one twisting or cabling machine comprises, as usual, a creel 4 positioned above or behind the workstation 1, which is used for mounting at least one first feed package 7 from which a so-called outer yarn 5 is drawn.

The workstation 1 also has a spindle 2, which is designed in the present example embodiment as a so-called cabling spindle.

The spindle 2 comprises a spindle pot 19 in which a second feed package 15 is mounted from which a so-called inner yarn 16 is drawn off over head which is supplied to a balloon eyelet arranged above the spindle 2 or a so-called balancing system 9.

The spindle pot 19 is mounted on the rotatable yarn deflection device 20 which is designed in the example embodiment of FIG. 1 as a twisting plate 8. The spindle pot 19 supported on the rotatable yarn deflection device 20 is thereby secured against rotation, preferably by a (not shown) magnet device.

The yarn deflection device 20 of the spindle 2 is pressurised by a spindle drive 3, in that, as in the example embodiment, it can either be a direct drive or an indirect drive.

In the latter case the yarn deflection device 20 is connected for example via a belt drive to a corresponding drive.

The outer yarn 5 drawn off the first feed package 7 is supplied to a controllable device 6 arranged in the yarn run between the creel 4 and the spindle 2 for influencing the yarn tension. This means that by means of the device 6 the yarn tension of the outer yarn 5 can be varied, if necessary.

The device 6 is connected via control lines 27 to a control circuit 18, which controls the yarn tension applied by the device 6 on the outer yarn 5.

As also shown in FIG. 1 the device 6 for influencing the yarn tension in yarn running direction is arranged in front of the yarn deflection device 20, which is designed in the example embodiment as a twisting plate 8.

This means that the outer yarn 5 after the device 6 runs through the spindle drive 3 in the region of the axis of rotation 28 of the spindle drive and exits underneath the twisting plate 8 through a so-called yarn exit bore 29 in radial direction out of the hollow axis of rotation 28 of the spindle drive 3.

The outer yarn 5 then runs to the outer area 30 of the twisting plate 8, where a fixed throw-off point 21 is installed for the outer yarn 5.

Said fixed throw-off point 21 can be designed as an eyelet 23 as shown for example in the embodiment of FIG. 1.

However, as will be explained in the following with reference to FIGS. 2-4, in connection with a yarn deflection device 20 which has a fixed throw-off point 21, other embodiments are possible and can be used in practice.

In the embodiment according to FIG. 1 the outer yarn 5 is deflected upwards in the region of the eyelet 23 of the twisting plate 8 and rotates forming a free yarn balloon B around the spindle pot 19 of the spindle 2, in which a second feed package 15 is positioned.

The outer yarn 5 drawn off the first feed package 7 and the inner yarn 16 drawn off the second feed package 15 are brought together in the region of the balloon eyelet or the balancing system 9.

As can be seen clearly, the height of the forming free yarn balloon B is determined by means of the position of the balloon eyelet or the balancing system 9.

In the balloon eyelet or in the balancing system 9 is the so-called cabling or also cording point, at which the two yarns, the outer yarn 5 and the inner yarn 16, run together and form for example a cord yarn 17.

Above the cabling point a yarn drawing device 10 is arranged by means of which the cord yarn 17 is drawn off and supplied via a balancing element, such as for example a compensator device 11, to a spooling and winding device 12.

The spooling and winding device 12 comprises, as usual, a drive roller 13 and a bobbin 14 driven frictionally by the drive roller 13.

In the method according to the invention the device 6 for influencing the yarn tension has the additional special task of varying, in particular increasing, the yarn tension of the outer yarn 5 ahead of the yarn deflection device 20 equipped with a fixed throw-off point 21, such that a storage disc can be omitted and also a co-rotating balloon limiting pot, which has previously been used for balancing unevenness in the yarn supply.

The yarn tension which can be controlled by the device 6 on the outer yarn 5 preferably has an order of magnitude which, depending on the geometry of the spindle 2, minimises the free yarn balloon B.

This is achieved by a fixed predetermined launch geometry of the outer yarn 5, which results from the fixed throw-off point 21 of the yarn deflection device 20.

This means that because of the fixed throw-off point 21 of the yarn deflection device 20 and the increased yarn tension in the region of the fixed throw-off point 21 there is automatically a launch angle of the outer yarn 5 which minimises the diameter of the forming free yarn balloon B.

As already described above in the method according to the invention or in the device according to the invention during the whole operating period of the device there is no yarn storage.

The device 6 for influencing the yarn tension can either be designed as an electronically controlled brake or as an active delivery device. Also a combination of the two aforementioned components can be used.

As embodiment variants of the delivery device for example a godet, a fan disc or a drive roller with corresponding pressing roller are possible. It is important that in order to maintain the free yarn balloon B to have as far as possible a constant, minimised diameter, by means of the device 6 it is always possible to actively influence the yarn tension by control.

This means that the control circuit 18 connected via control lines 27 to the device 6 uses for example the tension of the outer yarn 5 before or after the formation of the free yarn balloon B as an adjusting variable.

In order to immediately balance out fluctuations of yarn supply speeds which cause changes in the yarn tension, alternatively or in addition as an adjusting variable also the diameter of the yarn balloon B or the power consumption of the spindle drive 3 can be used.

The yarn tension for controlling the device 6 can be monitored electronically and/or mechanically, for example by a compensating roller or a conical roller.

When using a compensating roller, which is connected to the outer yarn 5, the deflection of the latter is detected on the basis of the changing yarn tension which is used as an adjusting variable of the device 6 for influencing the yarn tension.

Figure 2A:
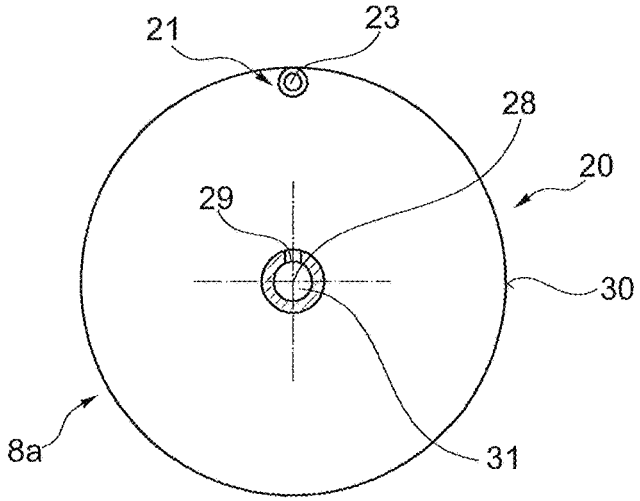
Figure 2B:
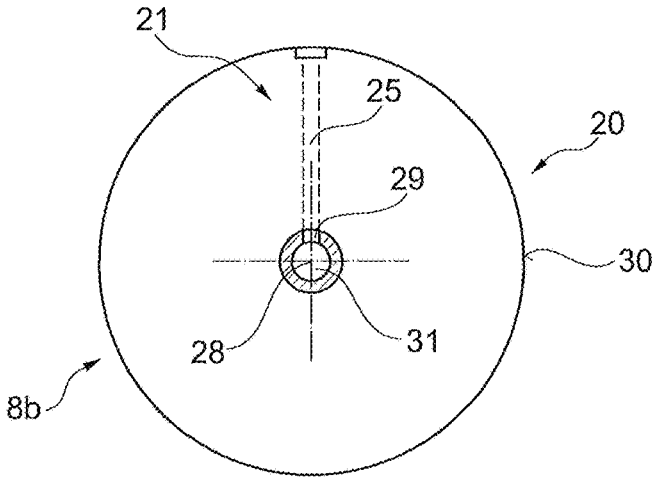
Figure 2C:
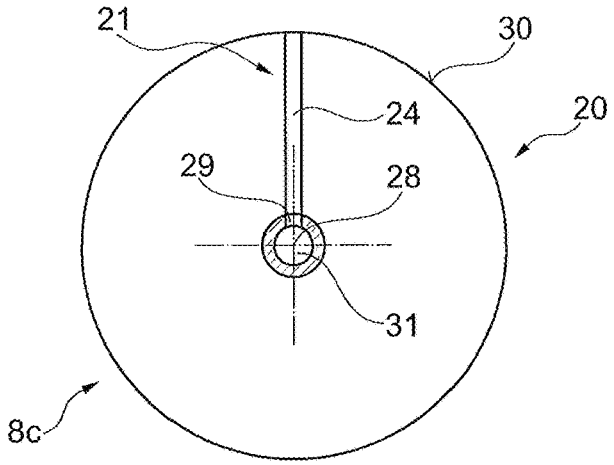

FIGS. 2*a*, 2*b* and 2*c* show different embodiments of a yarn deflection device 20 designed as a twisting plate 8*a*, 8*b*, 8*c* and equipped respectively with a fixed throw-off point 21.

The twisting plate 8*a* shown in FIG. 2*a* comprises, for example in the region of the axis of rotation 28 of the spindle 2, an axially running yarn guiding bore 31 and a yarn exit bore 29 branching radially from the latter.

Furthermore, the twisting plate 8*a* spaced apart from a radially arranged yarn exit bore 29 and slightly spaced apart from is outer area 30 has an eyelet 23, which is preferably made from a wear-distant material, for example ceramic, and which functions as a fixed throw-off point 21 for the yarn deflection device 20.

This means that during the operation of the spindle 2 the outer yarn 5 coming from the first feed package 7 rotates through the axis of rotation 28 of the spindle 2 into the yarn guiding bore 31 of the twisting plate 8*a* and then via the yarn exit bore 29 to the wear-resistant eyelet 23, which rotates with the twisting plate 8*a*.

The outer yarn 5 traversing the eyelet 23 is also subjected to rotation and thereby forms a yarn balloon B which is minimized with respect to its diameter.

The twisting plate 8*b* shown in FIG. 2*b* also comprises in the region of the region of the axis of rotation 28 of the spindle 2 an axially running yarn guiding bore 31 and a yarn exit bore 29 branching radially off the latter.

A preferably linear yarn guiding device leading to the outer area 30 of the twisting plate 8*b* is connected to the yarn exit bore 29, which yarn guiding device is designed either as shown in FIG. 2*b* as a closed channel 25 or as shown in FIG. 2*c* as a slot 24 open at the bottom.

The outlet point of the channel 25 or the slot 24 form respectively a fixed throw-off point 21 for the yarn deflection device 20 and are designed to be wear-resistant for example by having a ceramic lining.

This means in the embodiments shown in FIGS. 2*a*, 2*b* and 2*c* of a twisting plate 8*a*, 8*b*, 8*c* both the eyelet 23 and also the closed channel 25 or the slot 24 open at the bottom form respectively a fixed throw-off point 21 for the yarn deflection device 20.

Figure 3A:
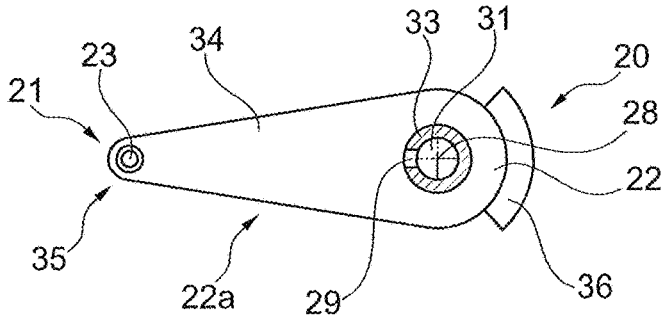
Figure 3B:
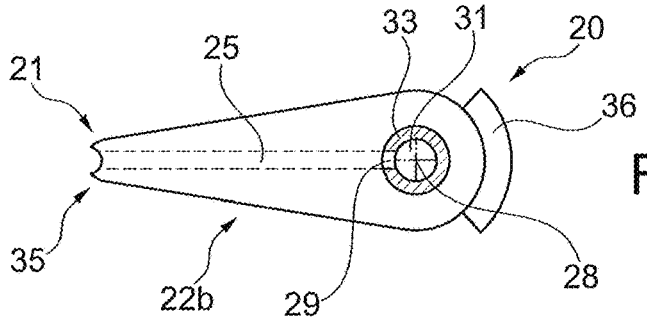
Figure 3C:
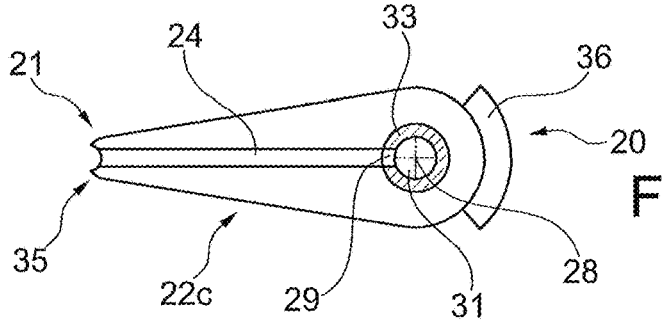

The FIGS. 3*a*, 3*b* and 3*c* show different embodiments of a yarn deflection device 20 designed as a twisting blade 22 and equipped with a fixed throw-off point 21.

The twisting blade 22*a* shown in FIG. 3*a* comprises for example a main body 33 designed in the form of a hub on which a blade-like shoulder 34 is formed which is equipped in its end section 35 with an eyelet 23 which is preferably made from wearing-resistant material, for example ceramic.

As known from the twisting plate 8*a*, the eyelet 23 also functions here as a fixed throw-off point 21 for the yarn deflection device 20.

Furthermore, in the region of the axis of rotation 28 of the spindle 2 or its main body 33 the twisting blade 22*a* also has an axially running yarn guiding bore 31 and a yarn exit bore 29 branching radially from the latter.

Preferably, the main body 33 of the twisting blade 22*a* or the blade-like shoulder 34 is also provided with a counterweight 36, which during the operation of the twisting blade 22*a* balances the centrifugal forces created by the blade-like shoulder 34.

Instead of a counterweight it would however also be possible to arrange a second opposite blade-like shoulder.

As with the twisting plate 8*a* when using a twisting blade 22*a* during the operation of the spindle 2 the outer yarn 5 coming from the first feed package 7 over an axial yarn guiding bore 31 arranged in the region of the axis of rotation 28 of the spindle 2 runs into the twisting blade 22*a* and via a yarn exit bore 29 branching radially from the axial yarn guiding bore 31 to a wear-resistant eyelet 23 arranged in the end section 35 of the blade 34.

The outer yarn 5 traversing the eyelet 23 is also rotated by the rotating twisting blade 22*a* and thereby forms a yarn balloon B, which is reduced to a minimum with respect to its diameter.

The twisting blade 22*b* shown in FIG. 3*b* also comprises in the region of the axis of rotation 28 of the spindle 2 an axially running yarn guiding bore 31 as well as a yarn bore 29 branching off the latter radially, to which a linear yarn guiding device leading to the end section 35 of the blade 34 is connected.

The linear yarn guiding device is either designed, as shown as in FIG. 3*b* by way of the twisting blade 22*b*, as a closed channel 25 or, as shown in FIG. 3*c* by way of the twisting blade 22*c* as a slot 24 open at the bottom.

The outlet point of the channel 25 or slot 24 thereby form a fixed throw-off point 21 for the yarn deflection device 20 designed as a twisting blade 22*b* or 22*c*.

Figure 4:
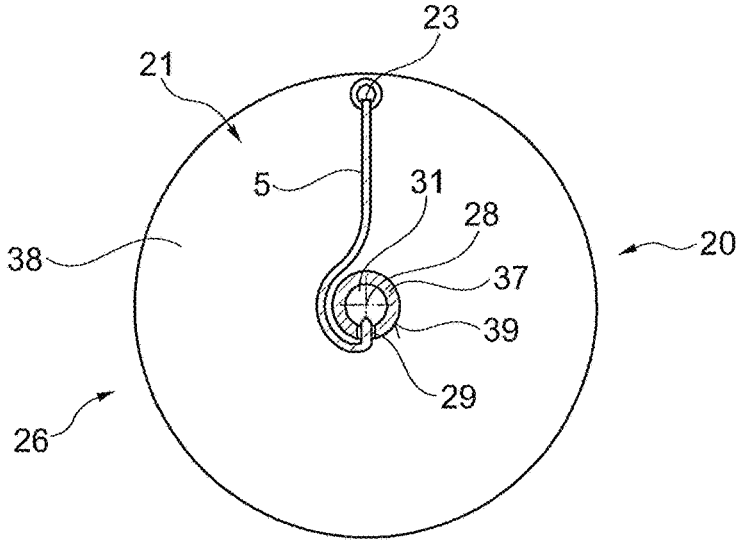
FIG. 4 shows a further embodiment of a yarn deflection device comprising a fixed throw-off point, in the present example embodiment a barrel tensioner, also in a view from below.

FIG. 4 shows as an alternative embodiment a yarn deflection device 20 designed as a barrel tensioner 26.

A construction of this kind comprises a hub-like main body 37, to which a plate-like shoulder 38 is connected.

The barrel tensioner 26 also has in the region of the axis of rotation 28 of the spindle 2 an axially running yarn guiding bore 31, from which a yarn exit bore 29 branches off radially, which ends in the region of the casing surface 39 of the main body 37.

On the side opposite the yarn exit bore 29 the plate-like shoulder 38 of the barrel tensioner 26 is equipped with an eyelet 23, which is preferably made from wear-resistant material, for example ceramic, and which functions as a fixed throw-off point 21 for the yarn deflection device 20.

This means that during the operation of the spindle 2 the outer yarn 5 coming from the first feed package 7 runs via the yarn guiding bore 31 into the main body 37 of the barrel tensioner 26 and via the radially arranged yarn exit bore 29 onto the casing surface 39 of the hub-like main body 37. The outer yarn 5 leaves the main body 37 after wrapping for example about 120° in the direction of the wear-resistant eyelet 23, which is arranged in the region of the plate-like shoulder 38 of the barrel tensioner 26 and which rotates with the barrel tensioner 26.

The outer yarn 5, which by means of its partial wrapping of the hub-like main body 37 of the barrel tensioner 26 is given an additional yarn tension, is also rotated by the rotating eyelet 23 and forms a yarn balloon B, which is minimised with respect to its diameter.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Method for operating a spindle (2) of a workstation (1) of a two-for-one twisting or cabling machine, in which an outer yarn (5) is drawn from a first feed package (7) and rotates in a yarn balloon (B) around the spindle (2), the spindle (2) having a device (6) for influencing the balloon yarn tension of an outer yarn (5) which is connected to a control circuit (18), and having a spindle pot (19) for receiving a second feed package (15), a yarn deflection device (20), a balancing system (9) for forming a twisting or cabling point and a spooling and winding device (12), characterized in that, the yarn balloon (B) is driven via a fixed throw-off point (21) on the yarn deflection device (20); and the workstation (1) is operated without a storage disc.

2. Method according to claim 1, characterized in that the workstation (1) is operated with a rotatably mounted barrel tensioner (26).

3. Method according to claim 1, characterized in that adjusting the yarn balloon form by the device (6) for influencing the balloon yarn tension.

4. Method according to claim 1, characterized in that the control circuit (18) controls the device (6) for influencing the balloon yarn tension such that the desired yarn balloon size is achieved.

5. Method according to claim 1, characterized in that the control circuit (18) controls the device (6) for influencing the balloon yarn tension such that there is always a minimal yarn balloon size.

6. Method according to claim 1, characterized in that the control circuit (18) when starting up or powering down the spindle (2) and in the case of a brief power cut controls the device (6) for influencing the balloon yarn tension such that a yarn balloon size is achieved which avoids contact with the spindle pot (19).

7. Two-for-one twisting or cabling machine comprising a spindle (2) of a workstation (1), which has a device (6) for influencing the balloon yarn tension of an outer yarn (5), which is connected to a control circuit (18), and has a spindle pot (19) for receiving a second feed package (15), a yarn deflection device (20), a balancing system (9) for forming a twisting or cabling point and a spooling and winding device (12), characterized in that, the rotatably mounted yarn deflection device (20) has a fixed throw-off point (21) for the outer yarn (5), and the workstation (1) is operated without a storage disc.

8. Two-for-one twisting or cabling machine according to claim 7, characterized in that the yarn deflection device (20) is in a form of a twisting plate (8*a*, 8*b*, 8*c*).

9. Two-for-one twisting or cabling machine according to claim 7, characterized in that the yarn deflection device (20) is in a form of twisting blades (22*a*, 22*b*, 22*c*).

10. Two-for-one twisting or cabling machine according to claim 7, characterized in that the fixed throw-off point (21) of the yarn deflection device (20) is formed by an eyelet (23).

11. Two-for-one twisting or cabling machine according to claim 7, characterized in that the fixed throw-off point (21) of the yarn deflection device (20) is formed by a slot (24) which is open at the bottom of the yarn deflection device (20).

12. Two-for-one twisting or cabling machine according to claim 7, characterized in that the fixed throw-off point (21) of the yarn deflection device (20) is formed by a closed channel (25).

13. Two-for-one twisting or cabling machine according to claim 7, characterized in that the fixed throw-off point (21) of the yarn deflection device (20) is a component of a rotatably-mounted barrel tensioner (26).

14. Two-for-one twisting or cabling machine according to claim 7, characterized in that the fixed throw-off point (21) is self-threading.

15. Two-for-one twisting or cabling machine according to claim 7, characterized in that the device (6) for influencing the balloon yarn tension is a brake.

16. Two-for-one twisting or cabling machine according to claim 7, characterized in that the device (6) for influencing the balloon yarn tension functions as a yarn delivery device.

* * * * *